US007370491B2

(12) United States Patent
Venkatakrishnan et al.

(10) Patent No.: US 7,370,491 B2
(45) Date of Patent: May 13, 2008

(54) METHOD AND APPARATUS FOR WATER DISPENSING SYSTEMS WITHIN A REFRIGERATOR

(75) Inventors: Natarajan Venkatakrishnan, Louisville, KY (US); Krzysztof Struminski, Louisville, KY (US); Ramesh Janardhanam, Louisville, KY (US); Balaji Parthasarathy, Karnataka (IN); Pravin Naphade, Maharashtra (IN)

(73) Assignee: General Electric Company, Schenectady, NY (US)

( * ) Notice: Subject to any disclaimer, the term of this patent is extended or adjusted under 35 U.S.C. 154(b) by 316 days.

(21) Appl. No.: 11/237,387

(22) Filed: Sep. 28, 2005

(65) Prior Publication Data

US 2007/0068190 A1 Mar. 29, 2007

(51) Int. Cl.
*F25D 23/12* (2006.01)

(52) U.S. Cl. ..... 62/338; 220/676; 220/669

(58) Field of Classification Search ..... 62/338, 62/339; 165/133; 220/565, 669, 675, 676
See application file for complete search history.

(56) References Cited

U.S. PATENT DOCUMENTS

| | | | | |
|---|---|---|---|---|
| 3,511,415 | A * | 5/1970 | Crowe | 222/146.1 |
| 3,834,178 | A | 9/1974 | Pink | |
| 3,938,689 | A * | 2/1976 | de Munnik | 220/646 |
| 4,739,629 | A | 4/1988 | True | |
| 4,879,185 | A * | 11/1989 | Masuda et al. | 428/687 |
| 5,315,845 | A | 5/1994 | Lee | |
| 6,354,458 | B1 * | 3/2002 | Policappelli | 220/674 |
| 6,920,992 | B2 * | 7/2005 | Lane et al. | 215/381 |

* cited by examiner

*Primary Examiner*—William E. Tapolcai
(74) *Attorney, Agent, or Firm*—George L. Rideout, Esq.; Armstrong Teasdale LLP

(57) ABSTRACT

A fluid storage tank includes a wall defining a cavity therewithin. An inlet opening is formed through the wall and provides communication between a fluid source and the cavity. A projection and at least one obstruction are positioned within the cavity. The projection directs a flow of a fluid entering the cavity through the inlet opening towards the obstruction. The obstruction interferes with and disperses the flow within the cavity. An outlet opening is formed through the wall and provides communication between the cavity and a fluid dispenser.

19 Claims, 6 Drawing Sheets

METHOD AND APPARATUS FOR WATER DISPENSING SYSTEMS WITHIN A REFRIGERATOR

BACKGROUND OF THE INVENTION

This invention relates generally to refrigerators, and more particularly, to water dispensing systems for refrigerators.

Refrigerators may include a water dispensing system having a water storage tank for storing and cooling water to be dispensed. Further, some water dispensing systems include a water filter connected to the water storage tank and located in a fresh food or freezer food compartment of the refrigerator.

Many conventional refrigerator water dispensers use a serpentine tank or a coiled tube to store and cool water. The cooled water is dispensed in a first in/first out basis. Due to the tank size and/or configuration, these conventional water dispensers can only dispense a limited amount of chilled water.

BRIEF DESCRIPTION OF THE INVENTION

In one aspect, the present invention provides a fluid storage tank including a wall defining a cavity therewithin. An inlet opening is formed through the wall and provides communication between a fluid source and the cavity. A projection is positioned within the cavity. The projection directs a flow of a fluid entering the cavity through the inlet opening towards at least one obstruction positioned within the cavity. The obstruction interferes with and disperses the flow throughout the cavity. An outlet opening is formed through the wall and provides communication between the cavity and a dispenser.

In another aspect, the present invention provides a water dispensing system including a fluid storage tank having a first wall portion and an opposing second wall portion connected with respect to each other to form a cavity therebetween. An inlet opening provides communication between a water source and the cavity. A plurality of obstructions is formed on an inner surface of the fluid storage tank and extends at least partially into the cavity. A first projection formed on the inner surface extends into the cavity. The first projection directs a flow of water entering the cavity through the inlet opening towards at least one obstruction. An outlet opening is formed at a top portion of the fluid storage tank. The outlet opening provides communication between the cavity and a dispenser. The water dispensing system further includes a filter in communication with the fluid storage tank and a cooling device proximate to the fluid storage tank and/or the filter.

In a further aspect, a refrigerator having a fluid storage tank is provided. The fluid storage tank includes a front wall, a back wall opposing the front wall, and a sidewall extending between the front wall and the back wall. A cavity is defined within the fluid storage tank. An inlet opening is formed in a bottom portion of a first sidewall portion. The inlet opening provides communication between a water source and the cavity. At least one support is formed in the front wall and/or the back wall. Each support extends at least partially into the cavity. A plurality of obstructions each are formed by an inner wall that extends between the front wall and the back wall and through the cavity. A projection is formed in a second sidewall portion. The projection extends into the cavity and is positioned downstream from the inlet opening. The projection directs a flow of water through the inlet opening towards at least one obstruction. An outlet opening is formed in the first sidewall portion. The outlet opening provides communication between the cavity and a water dispenser.

In yet another aspect, the present invention provides a method for providing chilled water. A quantity of water contained within a fluid storage tank is chilled. At least a portion of the quantity of chilled water is dispensed from an outlet opening formed in the fluid storage tank at a temperature greater than a storage temperature by mixing a quantity of incoming water at an ambient temperature received through an inlet opening with the quantity of chilled water contained within the fluid storage tank.

DETAILED DESCRIPTION OF THE INVENTION

The present invention provides a fluid storage tank or container for a water dispensing system, for example a refrigerator water dispensing system. In one embodiment, the fluid storage tank is included in a new water dispensing system. Alternatively, the fluid storage tank is retrofitted for use with an existing water dispensing system.

Figure 1:
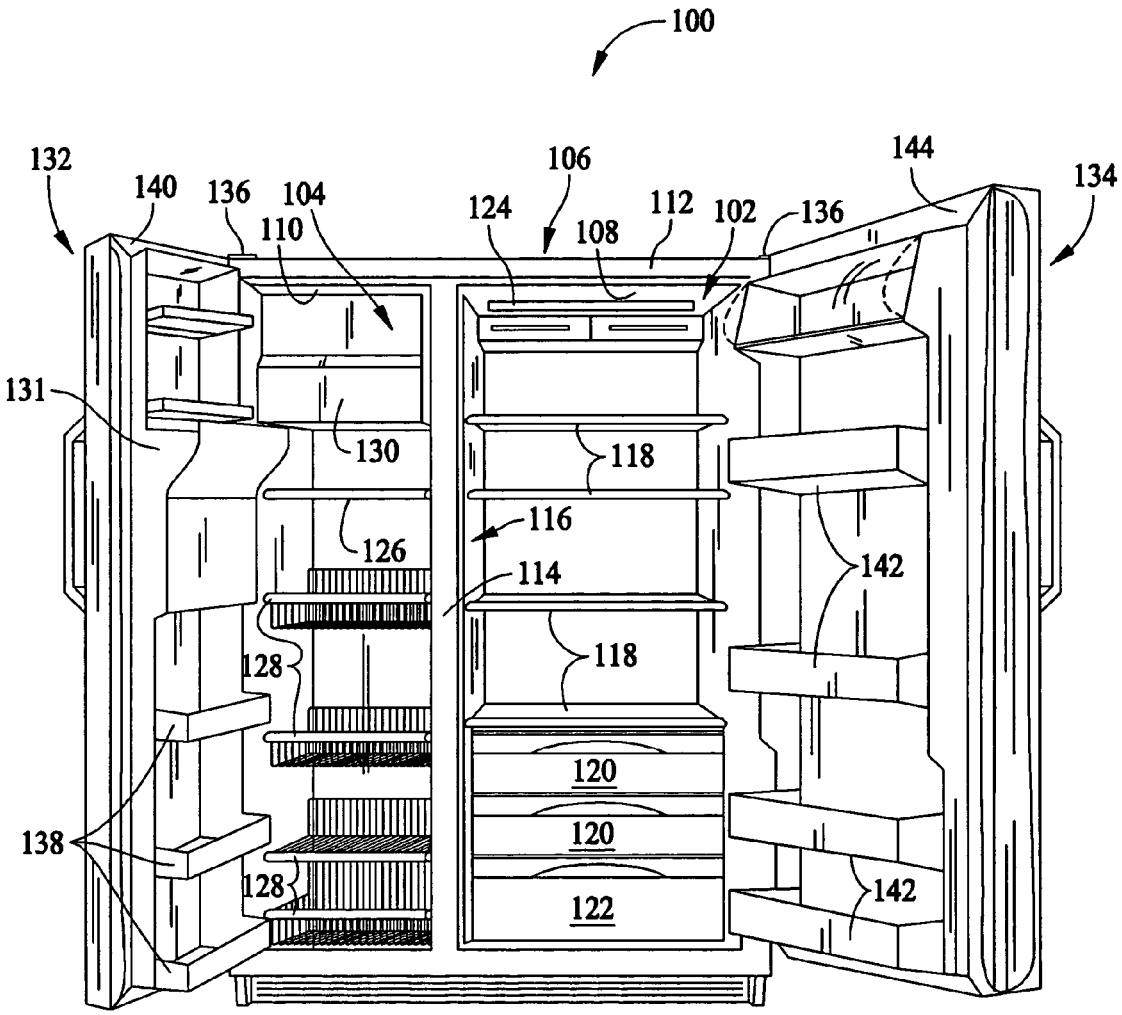
FIG. 1 is a perspective view of an exemplary refrigerator.

FIG. 1 is a perspective view of an exemplary refrigerator 100 in which exemplary embodiments of the present invention may be practiced and for which the benefits of the invention may be realized. It is appreciated, however, that the herein described method and apparatus may likewise be practiced in a variety of alternative refrigerators with modification apparent to those skilled in the art. Therefore, refrigerator 100 as described and illustrated herein is for illustrative purposes only and is not intended to limit the herein described method and apparatus in any aspect.

FIG. 1 illustrates a side-by-side refrigerator 100 including a fresh food storage compartment 102 and a freezer storage compartment 104. Freezer compartment 104 and fresh food compartment 102 are arranged side-by-side. In one embodiment, refrigerator 100 is a commercially available refrigerator from General Electric Company, Appliance Park, Louisville, Ky. 40225, and is modified to incorporate the herein described method and apparatus.

It is contemplated, however, that the teaching of the description set forth below is applicable to other types of refrigeration appliances, including, without limitation, top and bottom mount refrigerators. The herein described method and apparatus is therefore not intended to be limited to any particular type or configuration of a refrigerator, such as refrigerator 100.

Refrigerator 100 includes fresh food storage compartment 102 and freezer storage compartment 104 contained within an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case 106. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners 108, 110. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. In one embodiment, mullion 114 also preferably is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 may partly form a quick chill and thaw system (not shown) and are selectively controlled, together with other refrigerator features, by a microprocessor (not shown) according to user preference via manipulation of a control interface 124 mounted in an upper region of fresh food storage compartment 102 and coupled to the microprocessor. A shelf 126 and wire baskets 128 are also provided in freezer compartment 104.

The microprocessor is programmed to perform functions described herein, and as used herein, the term microprocessor is not limited to just those integrated circuits referred to in the art as a microprocessor, but broadly refers to computers, processors, microcontrollers, microcomputers, programmable logic controllers, application specific integrated circuits, and other programmable circuits, and these terms are used interchangeably herein.

Freezer compartment 104 includes an automatic ice maker 130 and a dispenser 131 is provided in freezer door 132 so that ice can be obtained without opening freezer door 132. As will become evident below, ice maker 130, in accordance with conventional ice makers includes a number of electromechanical elements that manipulate a mold to shape ice as it freezes, a mechanism to remove or release frozen ice from the mold, and a primary ice bucket for storage of ice produced in the mold. Periodically, the ice supply is replenished by ice maker 130 as ice is removed from the primary ice bucket. The storage capacity of the primary ice bucket is generally sufficient for normal use of refrigerator 100.

Figure 2:
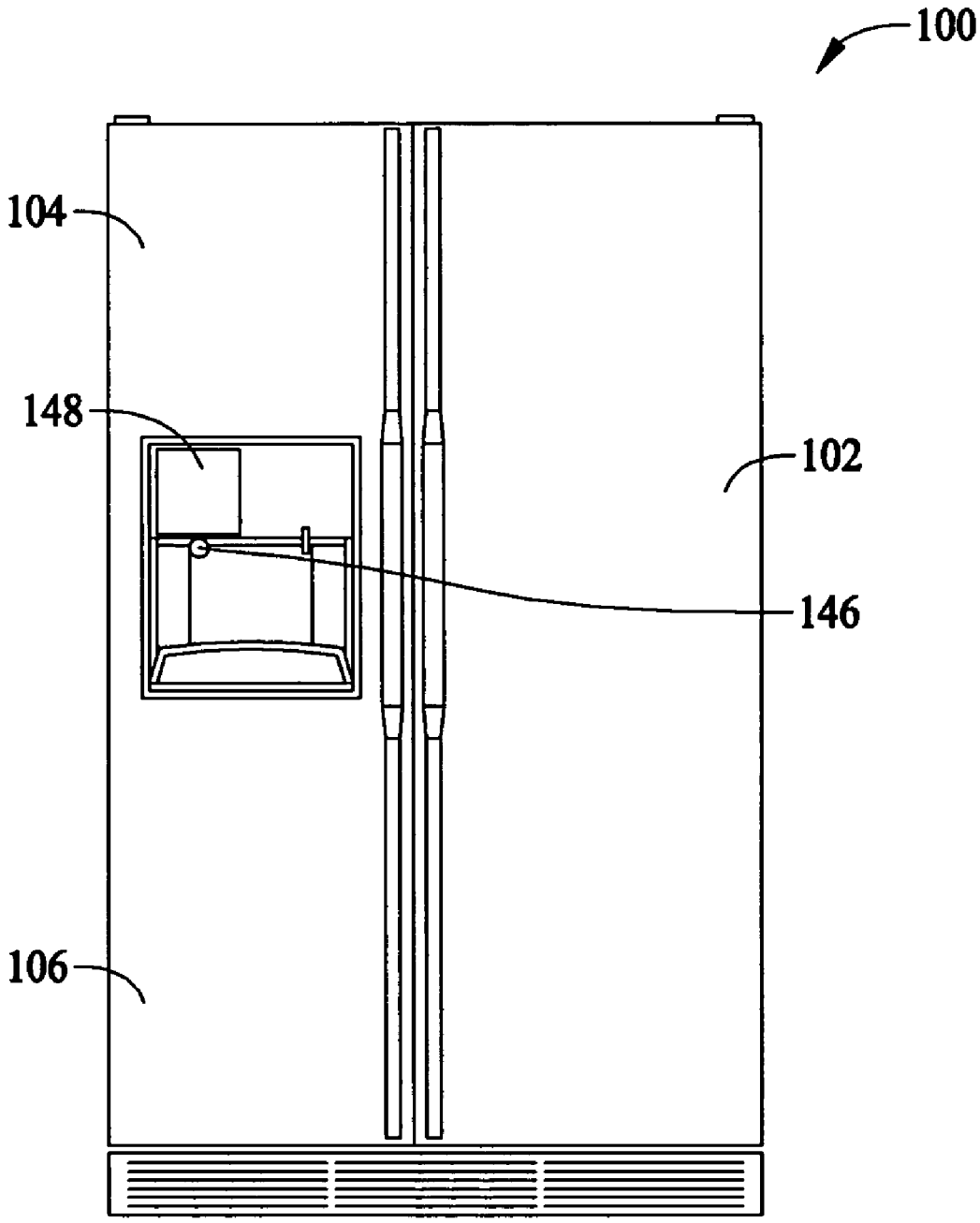
FIG. 2 is a front view of the refrigerator shown in FIG. 1.

Freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position, as shown in FIG. 2, closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown), a condenser (not shown), an expansion device (not shown), and an evaporator (not shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

FIG. 2 is a front view of refrigerator 100 with doors 102 and 104 in a closed position. Freezer door 104 includes a through the door water dispenser 146 and a user interface 148. Refrigerator 100 further includes a water dispensing system 200 connected to water dispenser 146.

Figure 3:
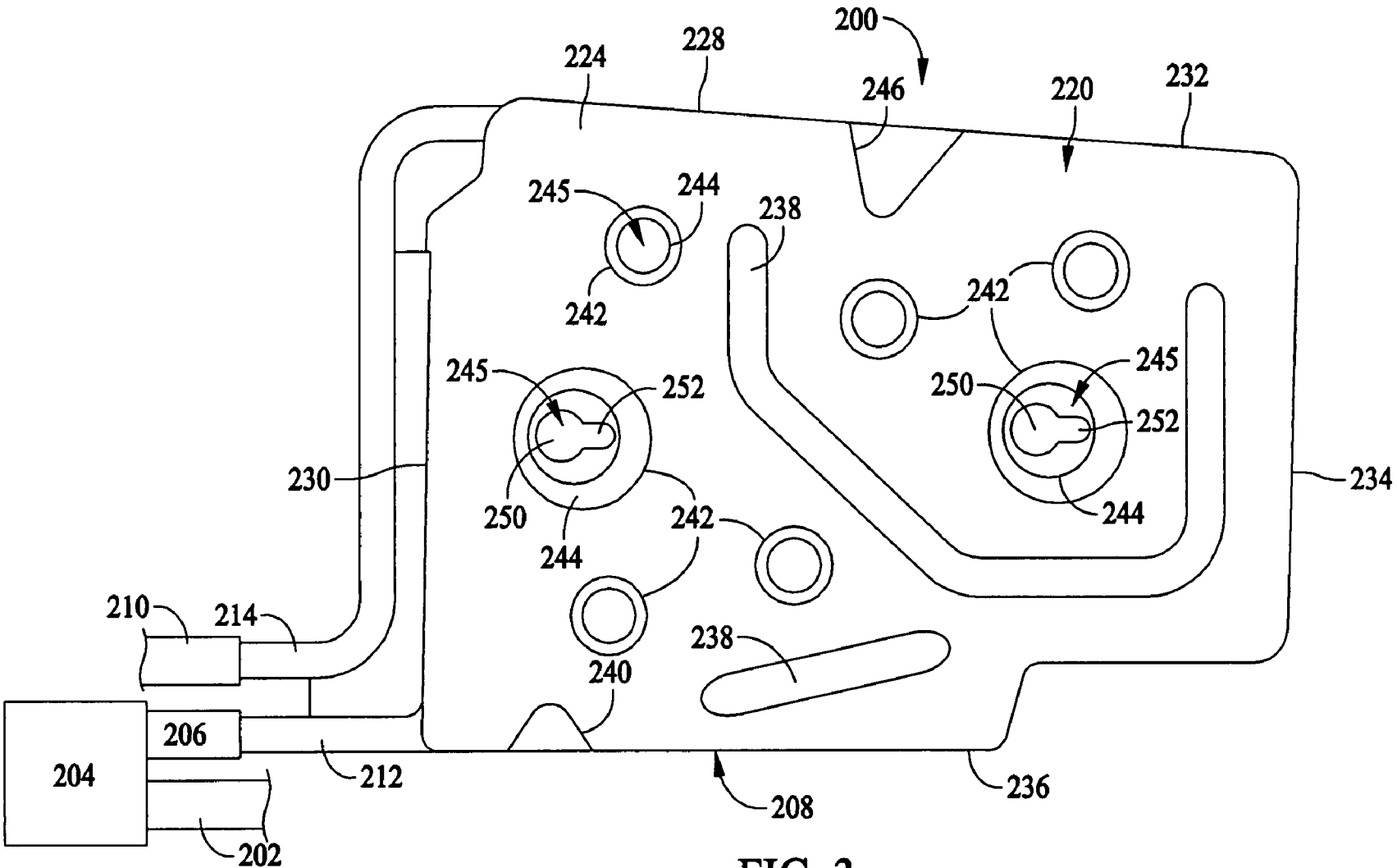
FIG. 3 is a front view of an exemplary fluid storage tank suitable for use within a refrigerator water dispensing system.
Figure 4:
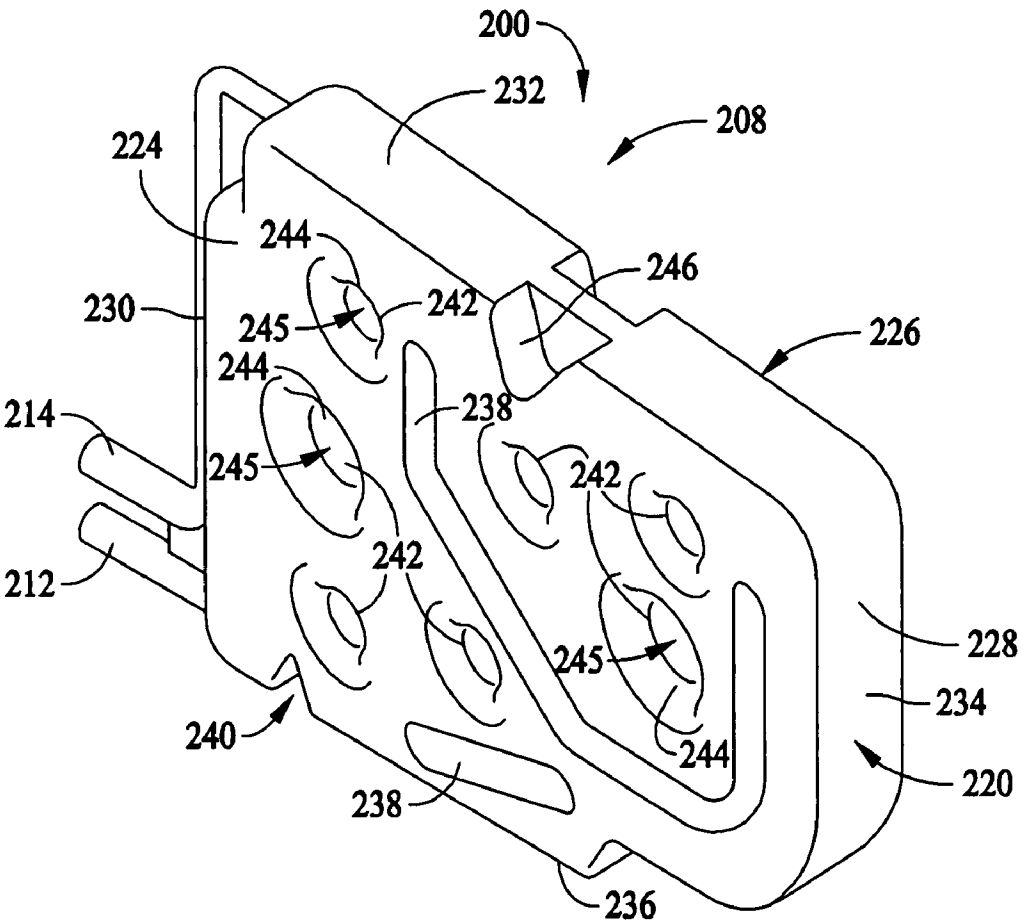
FIG. 4 is a perspective view of the fluid storage tank shown in FIG. 3.
Figure 5:
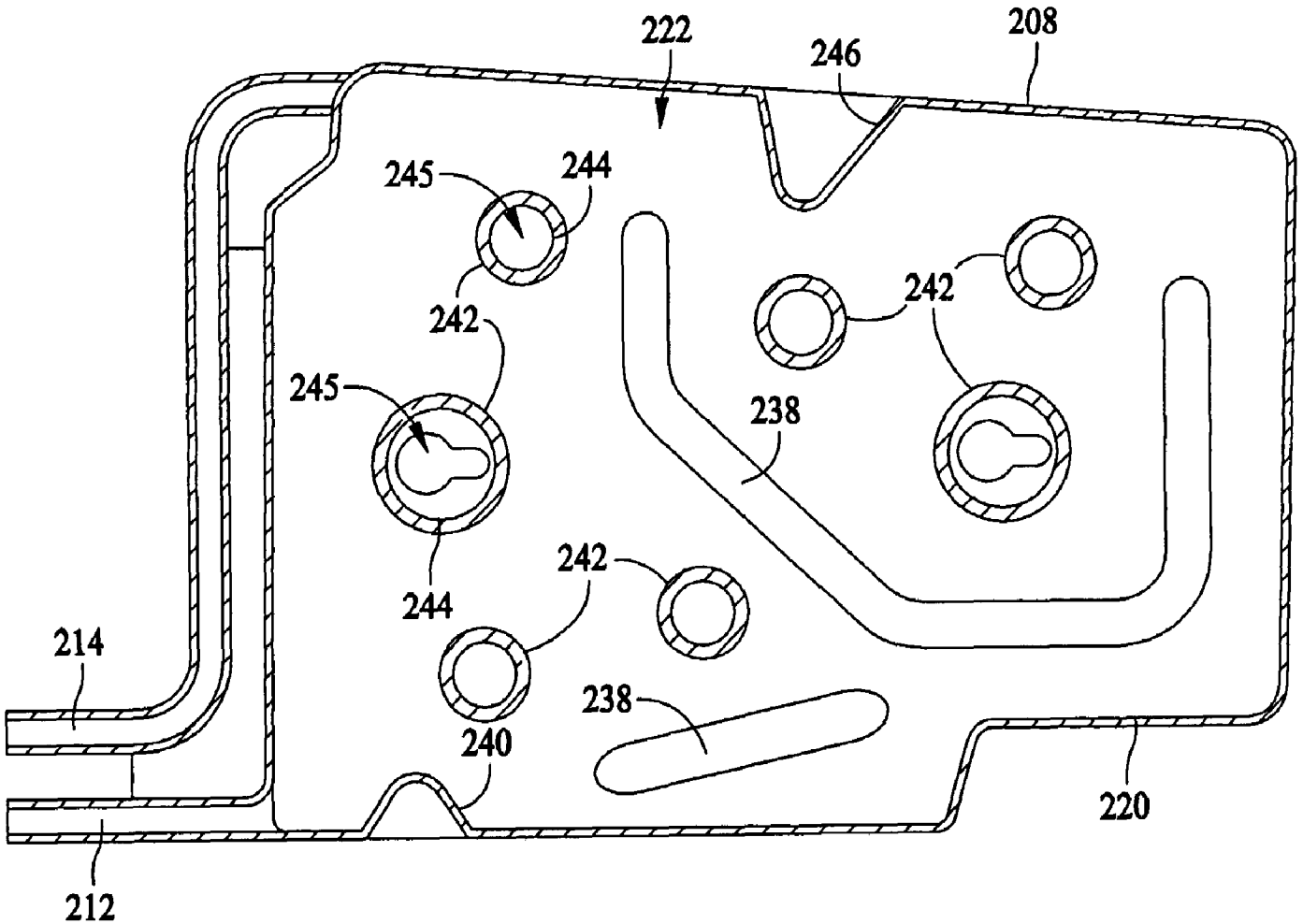
FIG. 5 is a cross-sectional view of the fluid storage tank shown in FIG. 3.

As shown in FIG. 3, water dispensing system 200 includes a fluid inlet line 202, a filter 204, a fluid intermediate line 206, a fluid storage tank or container 208, and a fluid outlet line 210. A fluid, such as water, is supplied to water dispensing system 200 through fluid inlet line 202 from a water source (not shown). In one embodiment cavity, filter 204 is connected between fluid inlet line 202 and tank 208, and intermediate line 206 extends from filter 202 to a valve (not shown). The valve controls fluid flow between filter 202 and tank 208 through intermediate line 206. In one embodiment cavity, the valve is actuated by user operation of water dispenser 146 using user interface 148.

Water dispensing system 200 receives unfiltered water entering through inlet line 202 from the water source. The unfiltered water passes through filter 204, whereby filtered water exits filter 204 to travel through intermediate line 206. Intermediate line 206 is connected to or fitted about an inlet opening 212 formed in tank 208. Filtered water is cooled during its passage through tank 208. Outlet line 210 is connected to or fitted about an outlet opening 214 formed in tank 208, and discharges cooled or chilled water to water dispenser 146 just prior to use.

Referring further to FIGS. 3-6, fluid storage tank or container 208 has a wall 220 that forms or defines a cavity 222 within tank 208. Cavity 222 is suitable or adapted for containing a quantity of fluid, such as water. In one embodiment, cavity 222 has a capacity of at least about 30 ounces to about 80 ounces. It is apparent to those skilled in the art that cavity 222 may have any suitable or desirable capacity. In alternative embodiments, cavity 222 may have a capacity less than about 30 ounces or greater than about 80 ounces. Referring to FIGS. 3-6, wall 220 may include a first or front wall 224, an opposing second or back wall 226 and a sidewall 228. First wall 224, second wall 226 and/or sidewall 228 are preferably integrated during the tank forming process, as discussed below. In one embodiment, side wall 228 includes a continuous sidewall or a plurality of sidewall portions or segments, such as sidewall segments 230, 232, 234 and 236, as shown in FIG. 3. In one embodiment, wall 220 includes a first wall portion and an opposing second wall portion connected with respect to each other, for example at a seam, and/or integrated with each other to form cavity 222 therebetween.

In one embodiment, tank 208 is made of a suitable material that can be easily fabricated, but is structurally rigid or stable to support a large quantity of fluid. Preferably, the material has suitable insulating properties to maintain the fluid contained within tank 208 at a desired temperature or within a desired temperature range. For example, a quantity of fluid, such as water, contained within tank 208 is maintained at a temperature of about 37° F. In one embodiment cavity, tank 208 is fabricated from a suitable polymeric material including, without limitation, a high density polyethylene, a low density polyethylene or a mixture thereof. Any suitable material known to those skilled in art, such as a suitable plastic, polymeric, metal, alloy and/or composite material, may be used to fabricate tank 208. In this embodiment, tank 208 can be fabricated using a suitable molding process, such as a blown molding process. Other suitable methods or processes known to those skilled in the art may be used to fabricate tank 208. In one embodiment, tank 208 has a generally rectangular cross-sectional shape, as shown for example in FIG. 6. In alternative embodiments, tank 208 has any suitable cross-sectional shape including, without limitation, a suitable polygonal or circular cross-sectional shape.

In one embodiment cavity, at least one support 238, and preferably a plurality of supports 238, is formed in or integrated with wall 220. Referring to FIGS. 3-6, wall 220 includes supports 238 formed in first wall 224 and/or second wall 226 that preferably extend into cavity 222. Supports 238 provide structural support and/or reinforcement to tank 208 to maintain wall 220 and cavity 222 in a desired configuration and prevent internal stress exerted by the fluid contained within tank 208 to expand or swell wall 220 outwardly with respect to cavity 222. In conventional water storage tanks or containers, such swelling or expansion typically results in the formation of leaks within the tank, for example at connections, openings and/or seams of the tank. Support 238 may have any size, shape and/or configuration suitable for providing the intended structural support and/or reinforcement to tank 208. Further, supports 238 may extend into cavity 222 to interfere with and/or disperse fluid within cavity 222.

As shown in FIGS. 3-6, tank 208 includes inlet opening 212 formed through wall 220. For example, in one embodiment, inlet opening 212 is formed in or by a bottom portion of a sidewall portion or segment, such as sidewall segment 230. Inlet opening 212 provides communication between a fluid source (not shown), through intermediate line 206, and cavity 222. A projection 240 is positioned within cavity 222. As shown in FIGS. 3-6, projection 240 is formed by or in wall 220, or integrated with sidewall segment 236, for example. Projection 240 extends into cavity 222 to interfere with and direct a flow of fluid entering cavity 222 through inlet opening 212. In one embodiment, projection 240 includes any suitable structure or component that interferes with and/or directs fluid flow, such as a bump, a ramp, an undulation, a constriction, a baffle and/or a ridge.

In one embodiment cavity, projection 240 deflects fluid flow towards at least one obstruction 242 positioned within cavity 222. In a particular embodiment, tank 208 includes a plurality of obstructions 242 positioned within cavity 222 and attached to, or integrated with, wall 220. For example, at least one obstruction 242 is formed in, or integrated with, first wall 224 and/or opposing second wall 226 and extend at least partially into cavity 222. Alternatively, or in addition, at least one obstruction 242 is formed between and connected to first wall 224 and second wall 226 to extend through cavity 222.

In one embodiment cavity, each obstruction 242 is formed by an inner wall 244 extending between first wall 224 and second wall 226. Inner wall 244 has an inner surface that is generally circular or arcuate and forms a void 245 through at least one of front wall 224 and back wall 226. In addition to supports 238, obstructions 242 provide additional structural support and/or reinforcement to tank 208 to maintain cavity 222 in a desired configuration and prevent internal stress exerted by the fluid contained within tank 208 to expand or swell wall 220 outwardly with respect to cavity 222. Obstructions 242 extend at least partially into cavity 222 to interfere with, disrupt and/or disperse the fluid flow throughout cavity 222. Obstructions 242 include any suitable structure or component that interferes with, directs and/or disperses the fluid throughout cavity 222, such as a bump, a ramp, an undulation, a constriction, a baffle and/or a ridge. As the incoming fluid is dispersed through cavity 222, the relatively warm incoming water, typically having an ambient temperature of at least about 70° F., mixes with the chilled water, having a temperature of about 37° F. The resulting chilled water has a temperature less than about 50° F. for dispensing through water dispenser 146.

In one embodiment cavity, projection 240, obstructions 242 and/or supports 238 are positioned within cavity 222 to create a pattern for the flow of fluid. As shown in FIGS. 3-6, obstructions 242 are positioned about or with respect to supports 238 to provide or create a flow pattern. Obstructions 242 may have any suitable or desirable size and/or shape. In one embodiment cavity, a projection 246, such as a bump, a ramp, an undulation, a constriction, a baffle and/or a ridge, is formed in sidewall segment 232 generally opposing side wall segment 236 that forms projection 240. Projection 246 extends into cavity 222 to further interfere with and/or disperse the fluid throughout cavity 222.

As shown in FIGS. 3-6, tank 208 includes outlet opening 214 formed through wall 220. In one embodiment cavity, outlet opening 214 is formed in, or by, a top portion of sidewall portion 230. Outlet opening 214 provides communication between cavity 222 and a suitable dispenser, such as water dispenser 146, through a suitable pipe, tube and/or valve. For example, outlet opening 214 is attached or connected to fluid outlet line 210 of refrigerator water dispenser system 200. In one embodiment cavity, inlet opening 212 and outlet opening 214 are positioned along or generally parallel with a vertical axis 300 of tank 208, with inlet opening 212 positioned below outlet opening 214, as shown for example in FIG. 6.

Figure 6:
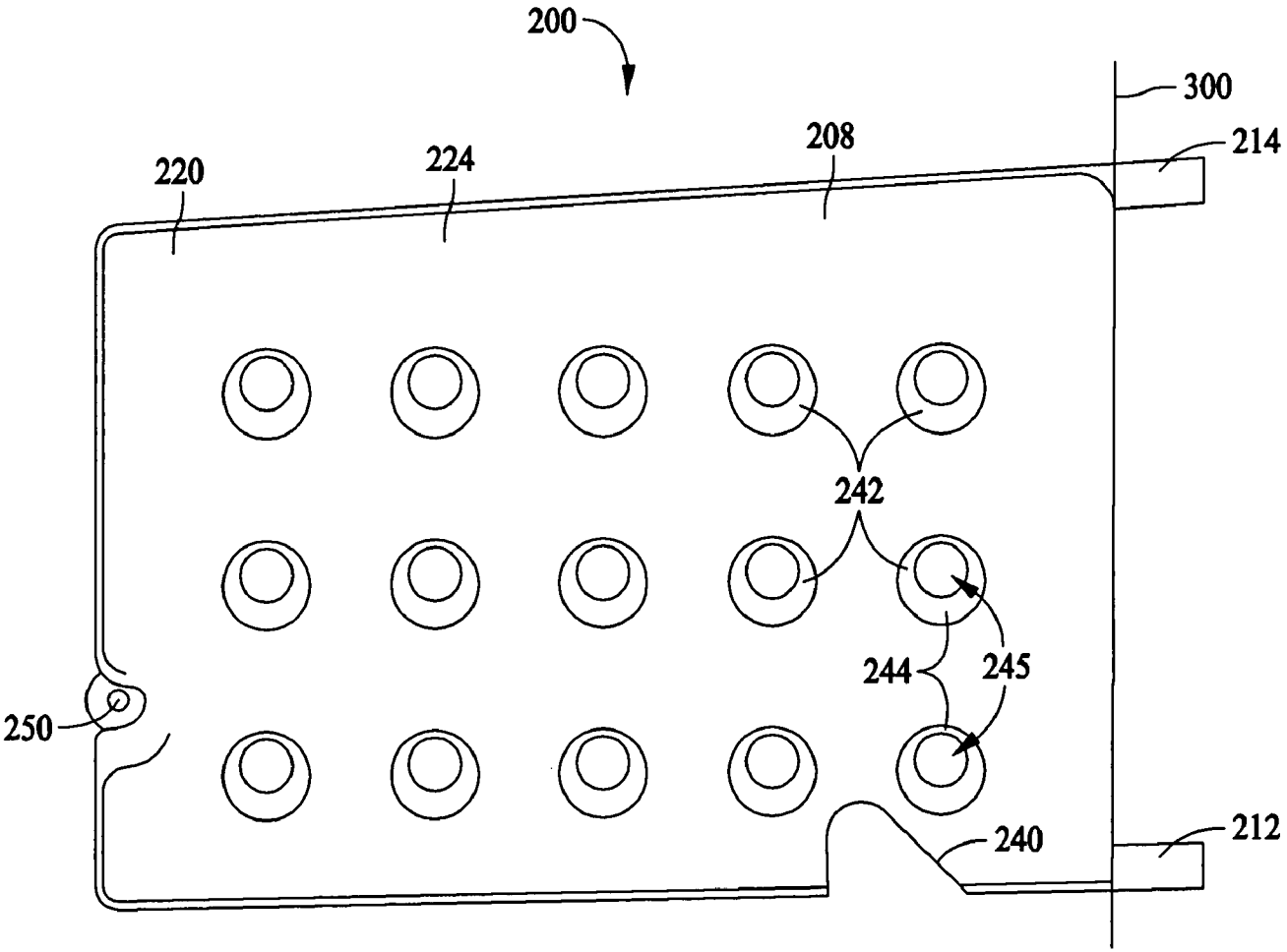
FIG. 6 is a front view of an exemplary fluid storage tank suitable for use within a refrigerator water dispensing system.

In one embodiment cavity, tank 208 includes at least one opening or aperture 250 for securing tank 208 to a surface, such as a wall surface of refrigerator 100. In one embodiment, tank 208 includes a plurality of apertures 250, as shown in FIG. 3, or one aperture 250, as shown in FIG. 6. Further, aperture 250 includes a fastener slot 252, within which a fastener, such as a sheet metal screw, can be slidably positioned and tightened to secure tank 208 to the refrigerator wall surface.

Water dispensing system 200 according to one embodiment, dispenses chilled water, as desired. Chilled water has a temperature less than about 50° F. A quantity of water is contained within tank 208 and cooled or chilled to a desirable temperature less than about 50° F., such as about 37° F.

Chilled water is dispensed from tank 208 through water dispensing system 200 from outlet opening 214, and an incoming stream or flow of water at an ambient temperature enters and/or is received by tank 208 through inlet opening 212. After the water flows through inlet opening 212, projection 240 directs the flow of water towards at least one obstruction 242, which interferes with and/or disrupts the incoming flow of water and disperses the water throughout cavity 222 to mix the incoming water, having an ambient temperature, with the remaining chilled water within cavity 222, having a temperature of about 37° F., resulting in a replenished quantity of chilled water within tank 208. In one embodiment, a mixing pattern is created within cavity 222 due to the position of each obstruction 242 with respect to projection 240, supports 238 and/or projection 246.

Water dispensing system 200 continues to cool or chill the replenished water to a desired temperature of about 37° F. Thus, water dispensing system 200 is capable of providing or dispensing a quantity or volume of chilled water, preferably having a dispensed temperature of less than about 50° F., that is at least about 80% of a capacity of tank 208. In one embodiment, water dispensing system 200 provides or dispenses a quantity of chilled water greater than a quantity or volume of chilled water initially contained within tank 208. For example, in one embodiment, a volume of the dispensed chilled water may exceed a volume of chilled water initially contained within tank 208.

The above-described water storage tank provides an effective and efficient apparatus for increasing a chilled water capacity in a refrigerator water dispensing system. More specifically, the water storage tank includes a projection for controlling a direction of water flow entering the water storage tank and at least one obstruction for dispersing the incoming water to provide a water flow pattern and disperse the incoming water throughout a volume of the water storage tank. The incoming water efficiently mixes with the chilled water contained within the water storage tank. As a result, the projection and/or the obstructions facilitate an efficient cooling or chilling of the water contained within the tank, thus enabling the water storage tank to hold and dispense a greater quantity of satisfactorily cold or chilled water.

Exemplary embodiments of the water storage tank are described above in detail. The water storage tank is not limited to the specific embodiments described herein, but rather, components of the water storage tank may be utilized independently and separately from other components described herein. For example, a projection and/or an obstruction can also be defined in, or used in combination with, other water storage tanks or water dispensing systems, and is not limited to practice with only the water storage tank as described herein. Rather, the present invention can be implemented and utilized in connection with many other water dispensing system configurations.

While the invention has been described in terms of various specific embodiments, those skilled in the art will recognize that the invention can be practiced with modification within the spirit and scope of the claims.

What is claimed is:

1. A fluid storage tank comprising:

a wall defining a cavity therewithin;

an inlet opening formed through said wall and providing communication between a fluid source and said cavity;

a projection formed in said wall and extending into said cavity;

at least one obstruction positioned within said cavity and coupled between a first wall portion and an opposing second wall portion of said wall, said projection directing a flow of a fluid entering said cavity through said inlet opening towards said at least one obstruction, said at least one obstruction interfering with and dispersing the flow within said cavity; and an outlet opening formed through said wall, said outlet opening providing communication between said cavity and a fluid dispenser.

2. A fluid storage tank in accordance with claim 1 further comprising at least one support formed in said wall.

3. A fluid storage tank in accordance with claim 1 wherein said projection comprises at least one of a bump, a ramp, an undulation, a constriction, a baffle and a ridge.

4. A fluid storage tank in accordance with claim 1 wherein said at least one obstruction comprises an inner wall having an inner surface with an arcuate shape, said inner wall forming a void through said wall.

5. A fluid storage tank in accordance with claim 1 wherein said at least one obstruction is formed by said wall and extends at least partially into the cavity.

6. A fluid storage tank in accordance with claim 1 wherein said at least one obstruction extends through the cavity between a first portion of said wall and an opposing second portion of said wall.

7. A fluid storage tank in accordance with claim 1 wherein a plurality of said obstructions are positioned within the cavity to disperse the flow throughout the cavity.

8. A fluid storage tank in accordance with claim 1 wherein each of said inlet opening and said outlet opening is positioned along a vertical axis of said fluid storage tank, said inlet opening positioned below said outlet opening.

9. A fluid storage tank in accordance with claim 1 further comprising one of a high density polyethylene, a low density polyethylene and a mixture thereof.

10. A fluid storage tank in accordance with claim 1 further comprising one of a plastic, polymeric, metal, alloy and composite material.

11. A fluid storage tank in accordance with claim 1 wherein said fluid storage tank is made of a molded material.

12. A water dispensing system comprising:

a fluid storage tank comprising:

a first wall portion and an opposing second wall portion connected with respect to each other and forming a cavity therebetween;

an inlet opening providing communication between a water source and the cavity;

a plurality of obstructions formed on an inner surface of said fluid storage tank and extending at least partially into the cavity;

a first projection formed on the inner surface and extending into the cavity, said first projection directing a flow of water entering the cavity through said inlet opening towards at least one obstruction of said plurality of obstructions; and an outlet opening formed at a top portion of said fluid storage tank, said outlet opening providing communication between the cavity and a water dispenser;

a filter in communication with said fluid storage tank; and a cooling device proximate to at least one of said fluid storage tank and said filter.

13. A water dispensing system in accordance with claim 12 wherein at least one obstruction of said plurality of obstructions extends between a first portion of said inner surface and an opposing second portion of said inner surface.

14. A water dispensing system in accordance with claim 12 further comprising at least one support formed on one of said first wall portion and said second wall portion, said at least one support extending into the cavity.

15. A water dispensing system in accordance with claim 12 wherein the cavity has a generally rectangular cross-sectional area.

16. A refrigerator having a fluid storage tank including a front wall, a back wall opposing said front wall, and a sidewall extending between said front wall and said back wall, said fluid storage tank comprising:

a cavity defined within said fluid storage tank;

an inlet opening formed in a bottom portion of a first sidewall portion of said sidewall, said inlet opening providing communication between a fluid source and the cavity;

at least one support formed in at least one of said front wall and said back wall, each said support of said at least one support extending at least partially into the cavity;

a plurality of obstructions each formed by an inner wall extending between said front wall and said back wall and through the cavity;

a projection formed in a second sidewall portion of said sidewall, said projection extending into the cavity and positioned downstream from said inlet opening, said projection directing a flow of fluid through said inlet opening towards at least one obstruction of said plurality of obstructions; and an outlet opening formed in said first sidewall portion, said outlet opening providing communication between the cavity and a fluid dispenser.

17. A refrigerator in accordance with claim 16 further comprising a second projection formed in a third sidewall portion of said sidewall, said third sidewall portion opposing said second sidewall portion.

18. A refrigerator in accordance with claim 16 wherein said plurality of obstructions are positioned within the cavity to create a pattern for the flow.

19. A refrigerator in accordance with claim 16 wherein said inner wall forms a void through at least one of said front wall and said back wall.

* * * * *